US005500062A

United States Patent [19]

Chattopadhyay

[11] Patent Number: 5,500,062

[45] Date of Patent: Mar. 19, 1996

[54] EMULSION EXPLOSIVE

[75] Inventor: Arun K. Chattopadhyay, McMasterville, Canada

[73] Assignee: ICI Canada Inc., Ontario, Canada

[21] Appl. No.: 932,313

[22] Filed: Aug. 20, 1992

[30] Foreign Application Priority Data

Aug. 30, 1991 [GB] United Kingdom ..... 9118628

[51] Int. Cl.[6] ..... C06B 31/28; C06B 31/30

[52] U.S. Cl. ..... 149/46; 149/60

[58] Field of Search ..... 149/46, 109.4, 149/60

[56] References Cited

U.S. PATENT DOCUMENTS

| | | | |
|---|---|---|---|
| 4,552,597 | 11/1985 | Abegg et al. | 149/2 |
| 4,818,309 | 4/1989 | Yabsley et al. | 149/2 |
| 4,863,534 | 9/1989 | Forsberg | 149/2 |
| 4,919,178 | 4/1990 | Riga et al. | 149/2 |
| 4,931,110 | 6/1990 | McKenzie et al. | 149/2 |
| 5,160,387 | 11/1992 | Sujansky | 149/2 |

FOREIGN PATENT DOCUMENTS

| | | |
|---|---|---|
| 615597 | 6/1990 | Australia . |
| 0155800 | 9/1985 | European Pat. Off. . |
| 0342871 | 11/1989 | European Pat. Off. . |
| 0389095 | 9/1990 | European Pat. Off. . |
| 2037269 | 7/1980 | United Kingdom . |
| 2050340 | 1/1981 | United Kingdom . |
| 8905785 | 6/1989 | WIPO . |

OTHER PUBLICATIONS

"Ullmann's Encyclopedia of Industrial Chemistry", Fifth, Completely Revised Edition, vol. A9: Dithiocarbamic Acid to Ethanol, pp. 306–325.

British Search Report, GB 9217062.0, M. J. Conlon, Oct. 12, 1992.

*Primary Examiner*—Donald P. Walsh
*Assistant Examiner*—Anthony R. Chi
*Attorney, Agent, or Firm*—Cushman Darby & Cushman

[57] ABSTRACT

A mixed surfactant system for use in emulsion explosives is provided which confers improved emulsion stability and comprises a surfactant and a co-surfactant, each having branched chain hydrocarbyl tail groups, the former having significantly longer tail chain groups than the latter, for which system poly[alk(en)yl] succinic anhydride based surfactants are especially preferred, said surfactants having an interaction parameter, β, which is less than zero.

11 Claims, 1 Drawing Sheet

EMULSION EXPLOSIVE

FIELD OF THE INVENTION

Figure 1:
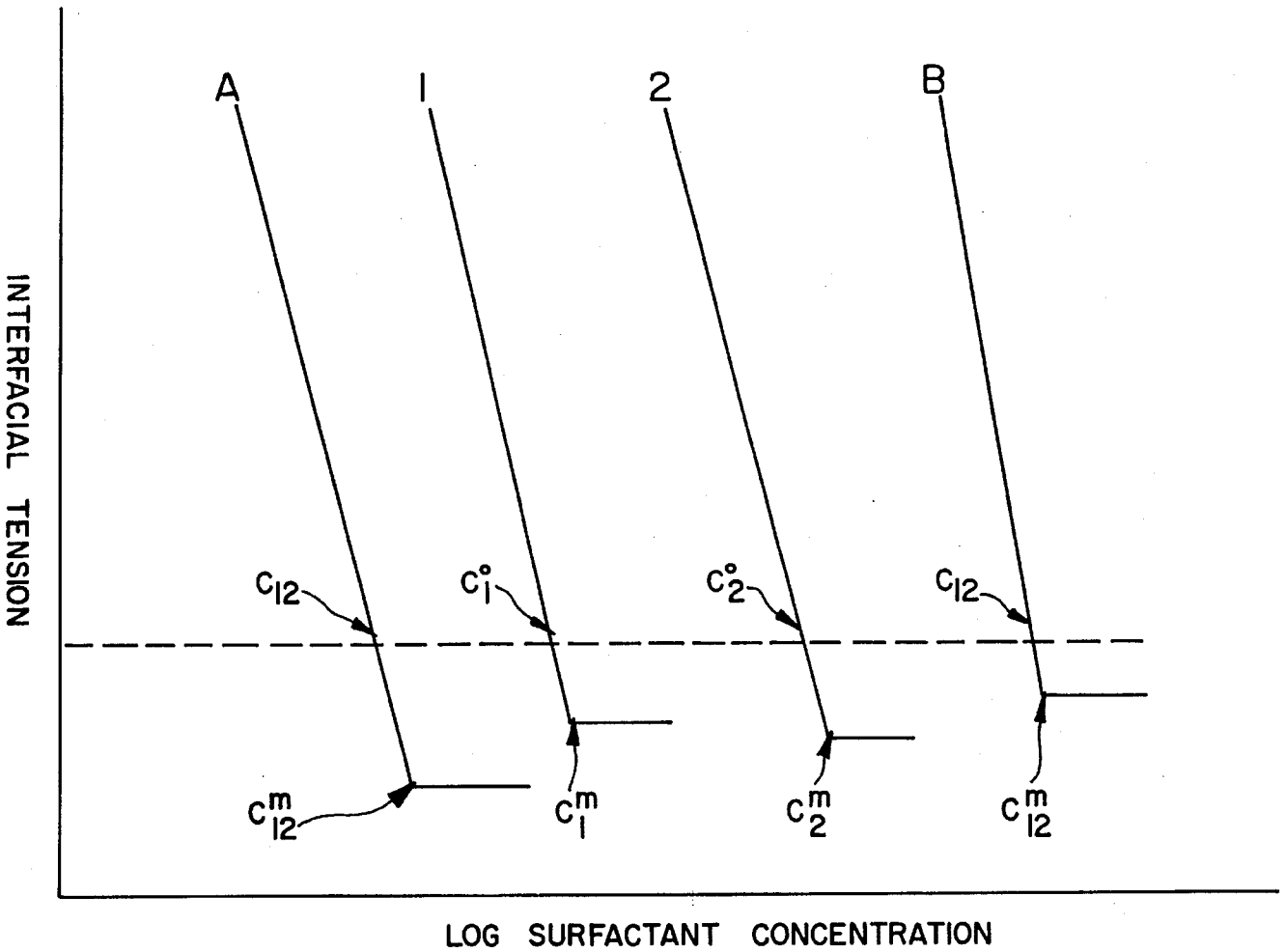

This invention relates to emulsion explosives, and in particular to explosives containing a mixed surfactant system.

DESCRIPTION OF THE RELATED ART

Water in oil emulsion explosives are well known in the explosives industry, and typically comprise an oxidizer salt-containing discontinuous phase which has been emulsified into a continuous fuel phase for which a variety of oils, waxes, and their mixtures have been employed. The oxidizer salt may be a concentrated aqueous solution of one or more suitable oxidizer salts or a melt of such salts containing a small proportion of water or even containing adventitious water only.

Emulsion explosives have been described by, for example, Bluhm in U.S. Pat. No, 3,447,978 which discloses a composition comprising an aqueous discontinuous phase containing dissolved oxygen-supplying salts, a carbonaceous fuel continuous phase, an occluded gas and a water-in-oil emulsifier. Cattermole et al., in U.S. Pat. No. 3,674,578, describe a similar composition containing as part of the inorganic oxidizer phase, a nitrogen-base salt such as an amine nitrate. Tomic, in U.S. Pat. No. 3,770,522 also describes a similar composition wherein the emulsifier is an alkali metal or ammonium stearate. Healy, in U.S. Pat. No. 4,248,644, describes an emulsion explosive wherein the oxidizer salt is added to the emulsion as a melt to form a "melt-in-fuel" emulsion.

Selection of the emulsifier used to prepare an emulsion explosive is of major importance in providing an emulsion which emulsifies easily, has a suitable discontinuous phase droplet size, and is stable during storage to prevent or lower the tendency for the oxidizer salt to crystallize or coalesce, since crystallization or coalescence will adversely affect the explosive properties of the emulsion explosive.

Australian Patent Application No. 40006/85 (Cooper and Baker) discloses emulsion explosive compositions in which the emulsifier is a reaction product of a poly[alk(en)yl] species (e.g. an alkylated succinic anhydride) and inter alia amines such as ethylene diamine, diethylene tetramine and mono- and di-ethanolamines.

McKenzie in U.S. Pat. No. 4,931,110 describes the use of a bis(alkanolamine or polyol) amide and/or ester derivatives of, for example, polyalk(en)yl succinic anhydride compounds as suitable surfactants. Polyalk(en)yl succinic anhydride compounds were described by Baker in Canadian Patent No. 1,244,463.

Forsberg et al. in U.S. Pat. No. 4,840,687, describe an emulsion explosive composition wherein the emulsifier is a nitrogen-containing emulsifier derived from at least one carboxylic acylating agent, a polyamine, and an acidic compound.

The prior art also includes specific examples of polyalkyl succinic acid salts and polyalkyl phenolic derivatives.

The formation of an emulsion explosive and the stabilization of an emulsion explosive once formed make a number of demands on an emulsifier system. A first requirement is an ability to stabilize new surfaces as the emulsion is formed by lowering the interfacial tension, i.e. an emulsifying capacity. The second requirement is an ability to form a structured bilayer (since an emulsion explosive is mainly composed of densely packed droplets of supersaturated dispersed phase in a fuel phase) so that the tendency, in an emulsion at rest, for droplets to coalesce and for crystallization of salts to spread from nucleated droplets to their dormant neighbours is suppressed. A third desired feature, related to the first but seemingly at odds with the second, would be an ability to preserve bilayer integrity dynamically when an emulsion explosive is sheared e.g. when being pumped. The industry response to these demands has been compromise formulations (or acceptance of operational restrictions). There are examples in the prior art referred to hereinabove where an emulsifier capable of structured packing in the bilayer is used in admixture with a smaller mobile surfactant that is an effective water-in-oil emulsifier for emulsion explosive production.

A particularly preferred mixed emulsifier system of the prior art, as described, for example, in the above-mentioned Cooper/Baker reference and by Yates et al. in U.S. Pat. No. 4,710,248, comprises a derivitised polyisobutene succinic anhydride surfactant, in combination with a co-surfactant such as sorbitan monooleate.

The effectiveness of emulsification of the oxidizer salts and liquid fuels as a promoter of explosive performance is dependent on the activity of the emulsifying agent chosen. The emulsifying agent aids the process of droplet subdivision and dispersion in the continuous phase by reducing the interfacial tension, and thus reducing the energy required to create new surfaces. The emulsifying agent also reduces the rate of coalescence by coating the surface of the droplet with a layer of molecules of the emulsifying agent. The emulsifying agents employed in the aforementioned prior art explosive compositions are somewhat effective in performing these functions, but improvements in the combination of properties exhibited by the emulsion system are still sought, especially for so-called repumpable (i.e. unpackaged) formulations of emulsion explosives.

Thus, it is desirable to provide an emulsion explosive emulsifier with improved properties so that it is both effective as an emulsifier and capable of resisting the tendency for the oxidiser phase of the explosive to crystallize and/or coalesce, especially when being sheared.

SUMMARY OF THE INVENTION

The present invention provides an emulsion explosive having a discontinuous oxidizer salt phase, a continuous oil phase, and an emulsifier for stabilization of the emulsions characterized in that said emulsifier comprises a surfactant mixture of a branched polyalkyl hydrocarbon surfactant and a branched polyalkyl hydrocarbon surfactant and a branched polyalkyl hydrocarbon co-surfactant, wherein said surfactant mixture has an interaction parameter ($\beta$) with a value below zero, preferably $-2$ or lower.

In the mixed surfactant system the interaction of the two or more surfactants can be measured to determine the degree of compatibility of the surfactants in the system. The average molecular surface area of the surfactant blend is measured and compared with the arithmetic mean of the molecular surface areas of the independent surfactants in a standard reference interfacial system. A reduction in average area can be attributed to the intermolecular attraction between the surfactant molecules, and an increase in area can be attributed to repulsion or increased disorder at the interface. These interactions can be quantified by a parameter, $\beta$, which is known as an interaction parameter, and determined as described hereinafter.

For attractive interactions between surfactants, β becomes negative which can be interpreted as positive synergism. For repulsive interaction, β becomes positive which can be interpreted as negative synergism or antagonism. The larger the numerical value of β, the stronger the interaction.

The Applicants have measured values of β, by the method specified hereinafter, for specific prior disclosed w/o emulsifier mixtures and have found values invariably positive for those mixtures. Generalised prior art disclosures to the effect that mixtures of W/O emulsifiers taken from given chemical classes (e.g. the same class or different classes) may be used in W/O explosive emulsions provide no teaching on selection and are wholly silent on the possibility that synergism, as reflected in negative β values, is achievable in the demanding context of emulsion explosive W/O emulsifier systems. Applicants have discovered that a selected relatively small number of mixed surfactants that together function as W/O emulsifiers for an emulsion explosives show negative β values. Applicants are not presently able to exhaustively or even predominantly characterise these select systems by reference to chemical structures of the constituent emulsifiers. Preferred chemical families of emulsifiers within which synergistic mixtures may be found are, however, identified hereins as are specific synergistic mixtures. Nevertheless a person skilled in the art of emulsion explosive manufacture, aided by persons skilled in emulsifier chemistry and interfacial tension measurement, can, by the methods specified herein, evaluate mixtures of emulsifiers to determine their β values and hence the extent of any attractive inter-molecular interaction.

The interaction parameter, β, for mixed surfactant monolayer formation at the liquid-liquid interface can be determined from plots of interfacial tension vs. total surfactant molar concentration. The method of determining the value of β, as used in this specification, is as follows:

The interaction parameter β is determined experimentally from a plot of the interfacial tension of an aqueous AN solution/oil phase interface versus log surfactant concentration for each of the two surfactants (surfactant and co-surfactant) in the system and a mixture of the two at a fixed mole fraction which has been previously determined to be optimum. The concentration of the aqueous AN solution sub phase is 35% AN m/m. The optimum mole fraction is determined from the minimum in the plot of interfacial tension versus mole fraction of one of the two surfactants mixed in various proportions (from 0 to 100%) in the surfactant mixtures, where the concentration of both of the surfactants remained above the critical concentration of the individual surfactants. The interfacial tension versus log surfactant concentration plots for single and mixed surfactant systems provide molar concentration values that produce a given interfacial tension value. This can be schematically represented in the FIG. 1.

According to FIG. 1, $C_{12}^M$, $C_1^M$ and $C_2^M$ are the critical concentration of the mixed surfactants, pure surfactant 1 and pure surfactant 2 respectively. The critical surfactant concentration is that concentration above which no further decrease in interfacial tension is determined with further increase in surfactant concentration. $C_{12}$, $C_1^0$ and $C_2^0$ are the concentrations of the surfactants required to produce a given interfacial tension value. The mixture of the two surfactants 1 and 2 at a given mole fraction produce synergism (as shown in A) when $C_{12}<C_1^0$, $C_2^0$. In case of antagonism (as shown in B) $C_{12}<C_1^0$, $C_2^0$.

The interaction parameter β can be calculated from the values of $C_{12}$, $C_1^0$ and $C_2^0$ by the following equations.

$$\frac{X_1^2 \ln(\alpha C_{12}/X_1 C_1^0)}{(1-X_1)^2 \ln[(1-\alpha)C_{12}/(1-X_1)C_2^0]} = 1 \qquad \text{Equation 1}$$

$$\beta = \frac{\ln(\alpha C_{12}/X_1 C^0)}{(1-X_1)^2} \qquad \text{Equation 2}$$

where α is the mole fraction of the surfactant 1 and (1-α) is the mole fraction of the surfactant 2 in the surfactant/oil mixture. $X_1$ is the mole fraction of surfactant 1 in the total surfactant in the mixed monolayer and the value of $X_1$ can be obtained by solving Equation 1.

Interfacial tensions at a mineral oil-aqueous ammonium nitrate solution interface were measured by the du Nouy ring detachment method. For all the single and mixed surfactant systems, a number of surfactant solutions in mineral oil were prepared by varying the molar concentration of surfactants. Each solution was then separately poured onto the surface of a 35% m/m aqueous ammonium nitrate solution and allowed sufficient time to equilibrate before measuring the interfacial tensions.

Interfacial tensions were measured by a Fisher Tensiomat (model 21) semi-automatic tensionmeter with a platinum-iridium ring.

The β parameters were determined by using $C_1^0$, $C_2^0$ and $C_{12}$ values taken from interfacial tension versus log concentration of surfactant plots at a certain value of interfacial tension where the slopes are almost linear.

In a mixed surfactant system containing a major proportion of one surfactant, wherein β is negative, the interfacial tension of the system will be less than the interfacial tension of a system having only that surfactant as the emulsifier. Preferably, the interfacial tension of the mixed surfactant system will be less than the interfacial tension of a system having any one of the surfactants of the mixture as its emulsifier.

Thus, for a two surfactant emulsifier mixture, it is preferred that an emulsifier mixture is utilized in an emulsion explosive for which the interfacial tension of the mixture is less than the interfacial tension of either surfactant alone as determined by the aforedescribed method.

It is not a necessary condition that the surfactants of the mixture should each be capable for forming a stable practically useful emulsion explosive formulation, only that the mixture should.

The term "branched polyalkyl hydrocarbon" is used in this specification to mean hydrocarbon chains derived from polymerised branched hydrocarbon monomers, especially isobutene. These chains may be attached in a variety of ways to a "head" group which is the hydrophilic salt-tolerant part of the surfactant molecule.

Preferably, at least one surfactant is a poly[alk(en)yl] succinic anhydride based compound derived from olefins preferably having from 2 to 6 carbon atoms which will form a branched chain hydrophobic structure preferably wholly free of unsaturation in the chain. Systems in which the surfactant and the co-surfactant have different repeat units in their chains are not excluded because differences do not necessarily imply antagonism and repulsion but preferably, however, the surfactant and co-surfactant are derived from the same monomer, most preferably isobutylene.

The head group may in such cases be inserted by reacting the succinic anhydride (or its acid form) with an amino- or hydroxyl-function, e.g. of a di- or polyamine (such as the poly[ethyl amine]s) or an ethanolamine (such as MEA or DEA) or a di-N-alkyl ethanolamine (in which case an ester link forms). A 1:1 molar ratio of reacting succinic anhydride and amino groupings allows for imide/amide formation. Intramolecular salt linkages may be present also. The formation of PiBSA derivatives and their use as emulsifiers for emulsion explosives is fully disclosed in the prior art including that referenced hereinabove. An alternative linking species to succinic anhydride is a phenolic link as also described in the prior art. A linking group such as these is used because it is chemically facile to produce a range of emulsifiers by the route of preforming a polyalkyl succinic anhydride (or phenol) reagent and then derivitizing it. The direct joining of a polyalkyl chain to, say, an alcohol or amine is less straightforward but the resulting emulsifiers are effective.

The polyalk(en)yl portion of each surfactant in a mixture of such surfactants will, as a consequence of its method of preparation, consist of a population of molecules of differing chain lengths. Typically, a graph of molecular weight against the amounts of constituent molecules having particular molecular weights will have the familiar pronounced "bell" shape. The molecular weight distribution may be indicated in a variety of ways. Preferred in the case of polymeric emulsifiers now used in emulsion explosives is average molecular weight because it does not indicate the molecular weight at and around which the bulk of the constituent molecules lie (the log normal distribution of molecular weights being relatively narrow and tall). Numerically stated, it is preferred that each surfactant should be one of which at least 75% of the polymeric tails of its constituent molecules lie in a band of molecular weight contributions between about 70% and about 130% of the number average polymeric tail molecular weight contribution as measured by the method of high performance size exclusion chromatography (HPSEC) with a photo-diode array UV-vis detector. The specific details of the method used to provide the data set out herein were as follows: The column set comprised Waters Ultra-Styragel 100, micro-styragel 500, Ultra-Styragel $10^3$ micro-styragel $10^4$. The molecular weight standards were narrowly polydisperse polystyrenes from Toyo Soda Chemical Company. The mobile phase was tetrahydrofuran maintained under a blanket of ultra-high purity helium. The method produces the chromatogram, calibration curve and molecular weight distribution. Typical molecular weight distributions for PiBSA (average molecular weight 1000), PiBSA (average molecular weight 450), and mixtures of PiBSA (MW 1000) and (MW 450) are indicated in the following Table II.

TABLE II

| Material PiBSAs (as purchased from trade sources) | $M_n$ (Number average $M_w$) | $M_w$ (weight) average $M_w$) | Polydispersity ($M_w/M_n$) |
|---|---|---|---|
| PiBSA-1000 Nominal | 683 | 993 | 1.45 |
| PiBSA-450 Nominal | 390 | 478 | 1.22 |
| 1:1 mixture of PiBSA-1000 and PiBSA-450 (calculated $M_n$ and $M_w$ are 536 and 735 respectively) | 480 | 720 | 1.50 |
| PiBSA-1300 Nominal | 710 | 1300 | 1.83 |
| 7:3 mixture of PiBSA-1300 and PiBSA-450 (calculated $M_n$ and $M_w$ are 614 and 1053 respectively) | 634 | 1024 | 1.61 |

For practical purposes, it can be assumed that the molecules of a given polymeric surfactant produced with a single head-group reagent will all have the same head group. The molecular weight population preference expressed hereinabove implies a similar band of chain lengths for the polymeric tail of the emulsifier where it consists, as is preferred, of repeat units of a single monomeric hydrocarbon moiety, such as iso-$C_4$. Thus a derivitised PiBSA emulsifier of which the PiBSA component has an average molecular weight of around 950–1000 will have an average carbon chain length of around 30–32 carbon atoms. The "75% population band" of chain lengths would then be from around 20 to around 42 carbon atoms.

For present purposes the mixed emulsifier system is preferably selected from bimodal mixtures of polymeric surfactants consisting essentially of 1. two polymeric surfactants having branched, preferably methyl-branched (preferably both iso $C_4$) hydrocarbyl repeat units in their alkyl tail chains;
2. one said surfactant has a number average carbon chain length of at least around 30 carbon atoms, especially in the range 30 to 60 carbon atoms (and preferably a "75% population band" as above defined);
3. the other said surfactant has a number average carbon chain length of at least 12 carbon atoms, especially in the range 12 to 30 carbon atoms (and preferably a "75% population band" as above defined);

and wherein (i) the number average carbon chain lengths of the said surfactants differ by at least 10 carbon atoms, preferably at least 18 carbon atoms, and (ii) each said surfactant has a molecular weight contribution from the portion of the molecule other than the alkyl tail (i.e. the head group inclusive of any linkage) less than 400, preferably less than 300, and more preferably less than 240.

The Applicants experience to date has shown that, for the requisite negative β value of practically suitable emulsifier systems, the head groups of the mixed surfactants will likely need to be different.

Guidance in selecting for test by the methods herein described suitable head groups for the mixed emulsifier is afforded by the Examples hereinafter. From the Examples it is reasonable to deduce:

a) the head groups should be capable of adopting a relative spatial alignment in the interfacial region such that their pendant hydrocarbyl tails can be drawn closely together (close parallelism);

b) the head group interactions must positively encourage the hydrocarbyl tails to be so drawn together;

c) the hydrocarbyl tails should themselves be chemically and sterically compatible, even similar, such that they will freely associate and form an array of closely packed co-extensive chains (i.e. no chemical repulsion or steric incompatibility);

d) there should desirably be sufficient relative mobility of one of the surfactants for it to be able to move into the interfacial region quickly to fill, and repair, gaps in the interfacial surfactant continuum.

Acceptable relative proportions of surfactant and co-surfactant are determinable experimentally. Preferably, the longer tail surfactant is the major molar component (>50% more preferably >70%) because of its importance to bi-layer dimensions and to emulsion stability in regions of salt crystallisation in nucleated droplets.

Typically, the total emulsifier component of the emulsion explosive comprises up to 5% by weight of the emulsion explosive composition. Higher proportions of the emulsifier component may be used and may serve as a supplemental fuel for the composition, but in general it is not necessary to add more than 5% by weight of emulsifier component to achieve the desired effect. Stable emulsions can be formed using relatively low levels of emulsifier component and, for reasons of economy, it is preferable to keep to the minimum amounts of emulsifier necessary to achieve the desired effect. The preferred level of emulsifier component used is in the range of from 0.4 to 3.0% by weight of the emulsion explosive, say 1.5 to 2.5% by weight.

The oxidizer salt for use in the discontinuous phase of the emulsion is selected from the group consisting of ammonium and alkali and alkaline earth metal nitrates and perchlorates, and mixtures thereof. It is particularly preferred that the oxidizer salt is ammonium nitrate, or a mixture of ammonium and sodium nitrates.

A very suitable oxidizer salt phase comprises a solution of about 77% ammonium nitrate and 11% sodium nitrate dissolved in 12% water (percentages being by weight of the oxidizer salt phase).

In general the oxidizer salt phase of commercial emulsion-explosives will contain a significant proportion of water and is reasonably described as a concentrated aqueous solution of the salt or mixture of salts. However, the oxidizer salt phase may contain little water, say less than 5% by weight, and in such a case be more correctly described as a melt.

The discontinuous phase of the emulsion explosive may be a eutectic composition. By eutectic composition it is meant that the melting point of the composition is either at the eutectic or in the region of the eutectic of the components of the composition.

The oxidizer salt for use in the discontinuous phase of the emulsion may further contain a melting point depressant. Suitable melting point depressants for use with ammonium nitrate in the discontinuous phase include inorganic salts such as lithium nitrate, sodium nitrate, potassium nitrate; alcohols such as methyl alcohol, ethylene glycol, glycerol, mannitol, sorbitol, pentaerythritol; carbohydrates such as sugars, starches and dextrins; aliphatic carboxylic acids and their salts such as formic acid, acetic acid, ammonium formate, sodium formate, sodium acetates and ammonium acetate; glycine; chloracetic acid; glycolic acid; succinic acid; tartaric acid; adipic acid; lower aliphatic amides such as formamide, acetamide and urea; urea nitrate; nitrogenous substances such as nitroguanidine, guanidine nitrate, methylamine nitrate, and ethylene diamine dinitrate; and mixtures thereof.

Typically, the discontinuous phase of the emulsion comprises 60 to 97% by weight of the emulsion explosive, and preferably 86 to 95% by weight of the emulsion explosive.

The continuous water-immiscible organic fuel phase of the emulsion explosive comprises an organic fuel. Suitable organic fuels for use in the continuous phase include aliphatic, alicyclic and aromatic compounds and mixtures thereof which are in the liquid state at the formulation temperature. Suitable organic fuels may be chosen from fuel oil, diesel oil, distillate, furnace oil, kerosene, naphtha, waxes, (e.g. microcrystalline wax, paraffin wax and slack wax), paraffin oils, benzene, toluene, xylene, asphaltic materials, polymeric oils such as the low molecular weight polymers of olefins, animal oils, fish oils, corn oil and other mineral, hydrocarbon or fatty oils, and mixtures thereof. Preferred organic fuels are liquid hydrocarbons, generally referred to as petroleum distillate, such as gasoline, kerosene, fuel oils and paraffin oils. More preferably the organic fuel is paraffin oil.

Typically, the continuous water-immiscible organic fuel phase of the emulsion explosive (including emulsifier) comprises more than 3 to less than 30% by weight of the emulsion explosive, and preferably from 5 to 15% by weight of the emulsion explosive.

If desired optional additional fuel materials, hereinafter referred to as secondary fuels, may be mixed into the emulsion explosives. Examples of such secondary fuels include finely divided materials such as: sulphur; aluminium; carbonaceous materials such as gilsonite, comminuted coke or charcoals carbon black, resin acids such as abietic acid, sugars such as glucose or dextrose and other vegetable products such as starch, nut meal, grain meal and wood pulp; and mixtures thereof.

Typically, the optional secondary fuel component of the emulsion explosive is used in an amount up to 30% by weight based on the weight of the emulsion explosive.

The explosive composition is preferably oxygen balanced or not significantly oxygen deficient. This provides a more efficient explosive composition which, when detonated, leaves fewer unreacted components. Additional components may be added to the explosive composition to control the oxygen balance of the explosive composition, such as solid particulate ammonium nitrate as powder or porous prill. The emulsion may also be blended with ANFO.

The explosive composition may additionally comprise a discontinuous gaseous component which gaseous component can be utilized to vary the density and/or the sensitivity of the explosive composition.

Methods of incorporating a gaseous component and the enhanced sensitivity of explosive compositions comprising gaseous components are well known to those skilled in the art. The gaseous components may, for examples be incorporated into the explosive composition as fine gas bubbles dispersed through the composition, as hollow particles which are often referred to as microballoons or microspheres, as porous particles of e.g. perlite, or mixtures thereof.

A discontinuous phase of fine gas bubbles may be incorporated into the explosive composition by mechanical agitation, injection or bubbling the gas through the composition, or by chemical generation of the gas in situ.

Suitable chemicals for the in situ generation of gas bubbles include peroxides, such as hydrogen peroxide, nitrites, such as sodium nitrite, nitrosoamines, such as N,N'-dinitrosopentamethylenetetramine, alkali metal borohydrides, such as sodium borohydride, and carbonates, such as sodium carbonate. Preferred chemicals for the in situ generation of gas bubbles are nitrous acid and its salts which decompose under conditions of acid pH to produce nitrogen gas bubbles. Preferred nitrous acid salts include alkali metal nitrites, such as sodium nitrite. These can be incorporated as an aqueous solutions a pre-emulsified aqueous solution in an oil phase, or as a water-in-oil micro emulsion comprising oil and nitrite solution. Catalytic agents such as thiocyanate or thiourea may be used to accelerate the decomposition of a nitrite gassing agent. Suitable small hollow particles include small hollow microspheres of glass or resinous materials, such as phenol-formaldehyde, urea-formaldehyde and copolymers of vinylidene chloride and acrylonitrile. Suitable porous materials include expanded minerals such as perlite, and expanded polymers such as polystyrene.

The Applicants have recently shown that gas bubbles may also be added to the emulsion as a preformed foam of air, $CO_2$, $N_2$ or $N_2O$ in liquid, preferably an oil phase.

The emulsion explosives of the present invention are, preferably, made by preparing a first premix of water and inorganic oxidizer salt and a second premix of fuel/oil and a mixture of the surfactant and co-surfactant in accordance with the present invention. The aqueous premix is heated to ensure dissolution of the salts and the fuel premix is heated as may be necessary to provide liquidity. The premixes are blended together and emulsified. Common emulsification methods use a mechanical blade mixer, rotating drum mixer, or a passage through an in-line static mixer. Thereafters the property modifying materials such as, for example, glass microspheres, may be added along with any auxiliary fuel, e.g. aluminium particles, or any desired particulate ammonium nitrate.

Accordingly, in a further aspect, the present invention provides a method of manufacturing an emulsion explosive comprising emulsifying an oxidizer salt phase into an emulsifier/fuel mixture, whereins said emulsifier is a mixture of surfactants which has an interaction parameter (β) with a value less than zero, preferably -2 or lower.

In a further aspect, the present invention also provides a method of blasting comprising placing a emulsion explosive as described hereinabove, in operative contact with an initiating system including a detonator, and initiating said detonator and thereby said emulsion explosive.

EXAMPLES

Various surfactants and blends of pairs of those surfactants were prepared as follows:

Surfactant I

A mixture of 40 parts of mineral oil and 60 parts of a polyisobutylene succinic anhydride (having an average molecular weight 1000, HPSEC), and 6.5 parts of a diethanolamine is heated to 80° C. for an hour. The reaction mixture is then further diluted by adding 10 parts of mineral oil and thus it forms the 50% active diethanolamine derivative of polyisobutylene succinic anhydride.

Surfactant II

A mixture of 40 parts of mineral oil and 60 parts of a polyisobutylene succinic anhydride (having an average molecular weight of 1000) was heated to 50° C. and then 4.1 parts of ethanolamine was added dropwise over a period of 30 minutes. The reaction mixture is then further diluted by adding 20 parts of mineral oil and then it forms the 50% active ethanolamine derivative of polyisobutylene succinic anhydride.

Surfactant III

A mixture of 20 parts of mineral oil and 80 parts of polyisobutylene succinic anhydride (having an average molecular weight 450, HPSEC,) is heated to 80° C. and then 18 parts of diethanolamine is slowly added with continuous stirring over a period of one hour. Thus it forms the desired diethanolamine derivative of polyisobutylene succinic anhydride of molecular weight 450.

Surfactant IV

A diethanolamine derivative of polyisobutylene succinic anhydride of average molecular weight 700 is prepared in a similar way as surfactant III by reacting the polyisobutylene succinic anhydride (80 parts) with 12 parts of diethanolamine amine.

Surfactant V

A mixture of 20 parts by weight of mineral oil and 80 parts by weight of polyisobutylene SA (average molecular weight of 450) is heated to 60° C. and 12 parts of ethanolamine is added dropwise to the mixture over a period of one hour. Thus it forms the desired ethanolamine derivative of polyisobutylene succinic anhydride of molecular weight 450.

Surfactant VI

The emulsifier is synthesized by following the method used for surfactant V. 7.5 parts of ethanolamine was added to polyisobutylene succinic anhydride of molecular weight 700 (80 parts) over a period of 1 hour.

Surfactant VII

A mixture of 40 parts by weight of mineral oil and 60 parts by weight of polyisobutylene succinic anhydride of average molecular weight 1000 is heated to 60° C. Then 5.8 parts of diethanolamine is added followed by the addition of 1 part of triethanolamine. The reaction mixture is then further diluted by adding 20 parts mineral oil and heated at 80° C. for an hour.

Surfactant VIII

A mixture of 80 parts of weight of polyisobutylene succinic anhydride (of average molecular weight 450) and 20 parts by weight of mineral oil was heated to 80° C. Then 16.5 parts of diethanolamine are slowly added followed by the addition of 2 parts of triethanolamine over a period of one hour.

Blend A

A mixed emulsifier blend of the desired composition (an optimum mixing ratio that has been determined by interfacial tension measurements) was made by mixing 70.1 parts of surfactant 1, 18.7 parts of surfactant V and 11.2 parts of mineral oil. Thus it forms 50% active mixed emulsifier blend.

Blend B

A mixed emulsifier blend at an optimum mixing ratio (determined by interfacial tension measurements) was made by mixing 70.1 parts of surfactant II, 18.7 parts of surfactant III and 11.2 parts of mineral oil. Thus it forms 50% active mixed emulsifier blend.

Blend C

Another mixed emulsifier blend was made by mixing 70.1 parts of the surfactant VII, 18.7 parts of surfactant VIII and 11.2 parts of mineral oil.

Blend D

A mixed emulsifier blend was made by mixing 80 parts of surfactant 1, 12.5 parts of surfactant VI and 7.5 parts of mineral oil.

Blend E

A mixed emulsifier blend was made by mixing 80 parts of surfactant II, 12.5 parts of surfactant IV and 7.5 parts of mineral oil.

Blend F

A mixed emulsifier blend was made by mixing 70.1 parts of surfactant I, 18.7 parts of surfactant III and 7.5 parts of mineral oil.

The molecular interaction parameters of various mixed surfactant systems have been measured and the relevant data are given in Table II.

TABLE II

| Surfactant Blend | $C_1^{0 \times 104}$ | $C_2^{0 \times 104}$ | $C_{12} \times 10^4$ | α | $X_1$ | β |
|---|---|---|---|---|---|---|
| Surfactant V + Surfactant I | 7.50 | 9.90 | 4.07 | 0.48 | 0.52 | −3.00 |
| Surfactant III + Surfactant II | 6.50 | 9.00 | 4.60 | 0.48 | 0.53 | −2.00 |
| Surfactant VI + Surfactant I | 5.00 | 5.20 | 3.60 | 0.32 | 0.40 | −1.50 |
| Surfactant IV + Surfactant II | 4.50 | 5.50 | 3.60 | 0.23 | 0.37 | −0.64 |
| Surfactant II + Surfactant I | 2.50 | 16.50 | 4.48 | 0.48 | 0.86 | 0.01 |
| Surfactant V + Surfactant II | 2.50 | 6.80 | 4.06 | 0.48 | 0.76 | 0.44 |
| Surfactant IV + Surfactant I | 3.00 | 3.10 | 4.50 | 0.40 | 0.20 | 1.70 |
| Surfactant VI + Surfactant II | 3.00 | 3.40 | 4.50 | 0.30 | 0.10 | 0.86 |
| Sorbitan Mono-oleate + Surfactant I | 2.00 | 8.60 | 3.00 | 0.40 | 0.87 | 3.96 |

The molecular interaction parameters evaluated using Equations I and II are used to predict whether synergism or antagonism will occur when two surfactants are mixed and, if so, the molar ratio of the two surfactants at which maximum synergism or antagonism will exist. A negative value indicates an attractive interaction between the two surfactants a positive value indicates a repulsive interaction. The larger the value of β, the stronger the interaction between the surfactants. A value close to zero indicates no interaction.

For the mixed surfactant systems of positive β values the $X_1$ (mole fraction of one of the mixed surfactants present at the interface) values indicate that either of the two components is predominantly absorbed at the interface. This indicates demixing of the two surfactant components at the interface. In that event, the interface in which two components are immiscible will constitute two separate domains of single surfactants. Such non-homogeneity at the interface causes instability.

The following examples are illustrative of both capsensitive packaged and cap-insensitive bulk explosive emulsions within the scope of invention.

Example 1

The following formulations (1a and 1b) of packaged emulsion explosives are compared where 1a represents the formulation based on a mixed emulsifier system of positive β value, and 1b represents the formulation based on the mixed surfactant systems of this invention where β value is negative. In the following table all numerical values are given in parts by weight.

TABLE 1

| | 1a | 1b |
|---|---|---|
| Ammonium Nitrate | 68.95 | 68.95 |
| Water | 10.75 | 10.75 |
| Sodium Nitrate | 9.85 | 9.85 |
| Polywax | 0.57 | 0.57 |
| Microcrystalline Wax | 0.28 | 0.28 |
| Surfactant 1 | 1.88 | — |
| Blend A | — | 2.82 |
| Sorbitan Mono Oleate | 0.47 | — |
| Paraffin Oil | 2.25 | 1.78 |
| Glass Microballoons | 5.00 | 5.00 |

The properties of the formulation 1a and 1b are compared from the data given in the following Table 2.

TABLE 2

| | 1a | 1b |
|---|---|---|
| Average droplet size (micron) | 2.1 | 1.8 |
| Storage stability at room temp. (week) | 50 | >50 |
| Storage stability at 50° C. (weeks) | 25 | >35 |
| Specific conductivity (pmho/m) at | | |
| 30° C. | 396 | 47 |
| 40° C. | 908 | 111 |
| 50° C. | 990 | 339 |
| 60° C. | 1338 | 1036 |
| 70° C. | 2075 | 1413 |
| Minimum initiator (cartridge diam. 25 mm) | R-5 | R-4 |
| Velocity of detonation (m/sec) | 4320 | 4472 |
| Gap sensitivity (cm) | 5.5 | 7.5 |

Although the formulations are inherently stabled, the differences in the longer term storage stability and in the explosives properties are readily noticeable. The trend in the conductivity results is also indicative of the improved stability of emulsion of formulation 1b based on the mixed emulsifiers of present invention. The lower conductivity, the higher the inherent storage stability.

Example 2

The following formulations (2a and 2b) of cap-sensitive packaged emulsion explosives are compared with regard to their storage stability and explosives properties. 2a comprises a single emulsifier system of surfactant II whereas 2b comprises the mixed emulsifier system of Blend A. Compositions are shown in Table 3 and the properties are given in Table 4.

TABLE 3

| | 2a | 2b |
|---|---|---|
| Ammonium Nitrate | 72.65 | 72.65 |
| Sodium perchlorate | 8.12 | 8.12 |
| Water | 9.48 | 9.48 |
| Paraffin wax | 0.69 | 0.69 |
| Microcrystalline Wax | 1.06 | 1.06 |
| Surfactant II | 3.00 | — |
| Blend A | — | 3.00 |
| Glass Microballoons | 5.00 | 5.00 |

TABLE 4

| | 2a | 2b |
|---|---|---|
| Average droplet size (micron) | 2.8 | 2.2 |
| Storage stability at room temp. (week) | 35 | >43 |
| Storage stability at 50° C. (weeks) | 7 | >10 |
| Specific conductivity (pmho/m) at | | |
| 30° C. | 122 | 11 |
| 40° C. | 209 | 22 |
| 50° C. | 350 | 140 |
| 60° C. | 866 | 364 |
| 70° C. | 1410 | 800 |
| Minimum initiator (cartridge diam. 25 mm) | R-5 | R-5 |
| Velocity of detonation (m/sec) | 4700 | 4700 |
| Gap sensitivity (cm) | 7.0 | 9.5 |

In this example the trend in the conductivity results, storage stability data and gap sensitivity data reveal the superior performance of mixed emulsifiers of Blend A (where the interaction parameter β is negative) of the present invention.

Example 3

This example illustrates the comparison of properties of two emulsion explosives formulations based on the mixed surfactant systems of the present invention. One of the formulations is based on the mixed surfactant system Blend A whose interaction parameter β is negative and the other one is based on the mixed surfactants Blend F whose interaction parameter is zero. The formulations are given in Table 5 and the properties are compared in Table 6.

TABLE 5

| | 3a | 3b |
|---|---|---|
| Ammonium Nitrate | 78.7 | 78.7 |
| Water | 16.0 | 16.0 |
| Mineral Oil | 2.3 | 2.3 |
| Blend A | — | 3.0 |
| Blend F | 3.0 | — |

TABLE 6

| | 3a | 3b |
|---|---|---|
| Droplet size (micron) | 2.38 | 2.58 |
| Storage stability at room temp. (week) | <6 | >20 |
| Membrane conductivity (milli-mhos/$m^2$) | 35.3 | 0.072 |
| Membrane thickness (nm) | 5.76 | 8.26 |

The membrane conductivity and membrane thickness are measured from the emulsion conductivity and dielectric spectra of emulsions. The increased stability results if the membrane separating the droplets is thick but more particularly if it has an optimised molecular order. The mixed surfactants Blend A produce emulsions of very low membrane conductance suggesting good emulsion stability.

Example 4

The following formulations (4a, 4b, 4c and 4d) of solid fuel doped emulsion explosives are compared where 4a represents the formulation based on a mixed emulsifier system of positive β value, and 4b–4d are based on the mixed emulsifier systems of this invention where β values are negative. Formulations are given in Table 7 in parts by weight and properties are compared in Table 8.

TABLE 7

| | 4a | 4b | 4c | 4d |
|---|---|---|---|---|
| Ammonium Nitrate | 75.60 | 74.60 | 74.60 | 74.60 |
| Water | 15.20 | 15.20 | 15.20 | 15.20 |
| Thiourea | 0.05 | 0.05 | 0.05 | 0.05 |
| Acetic Acid | 0.04 | 0.04 | 0.04 | 0.04 |
| Sodium acetate | 0.08 | 0.08 | 0.08 | 0.08 |
| Surfactant II | 2.00 | — | — | — |
| Sorbitan mono oleate | 0.50 | — | — | — |
| Blend A | — | 2.50 | — | — |
| Blend B | — | — | 2.50 | — |
| Blend C | — | — | — | 2.50 |
| Paraffin oil | 2.47 | 2.47 | 2.47 | 2.47 |
| Ferro silicon | 5.00 | 5.00 | 5.00 | 5.00 |

These emulsions are optionally gassed using 0.06 parts equivalent of sodium nitrite either in the form of aqueous solution or in the form of water-in-oil type microemulsion added to the premade emulsions of the above formulations.

TABLE 8

| | 4a | 4b | 4c | 4d |
|---|---|---|---|---|
| Average droplet size (μ) | 2.2 | 1.85 | 2.0 | 1.8 |
| Storage stability at room temp. (weeks) | <10 | >30 | >30 | >35 |
| Storage stability at 50° C. | <2 | >4 | >4 | >4 |

Example 5

In the following examples stability of the emulsion formulations (Table 9 and 10) doped with solid ammonium nitrate prills are compared.

TABLE 9

| | 5a | 5b |
|---|---|---|
| Ammonium Nitrate | 49.35 | 49.35 |
| Water | 10.08 | 10.08 |
| Thiourea | 0.03 | 0.03 |
| Acetic Acid | 0.03 | 0.03 |
| Sodium Acetate | 0.05 | 0.05 |
| Surfactant II | 1.30 | — |
| Sorbitan Mono Oleate | 0.33 | — |
| Blend B | — | 1.95 |
| Paraffin Oil | 3.83 | 3.83 |
| Solid ammonium nitrate prills | 35.00 | 35.00 |

The above formulations can be optionally gassed by using aqueous solutions of sodium nitrate or water-in-oil microemulsions of aqueous sodium nitrite solutions.

TABLE 10

| | 5a | 5b |
|---|---|---|
| Average emulsion droplet size (micron) | 2.2 | 2.0 |
| Storage stability at room temp. (week) | 4 | >8 |
| Storage stability at 50° C. (weeks) | <2 | >2 |

Example 6

In the following examples stability of the bulk repumpable emulsion formulations (Table 11 and 12) doped with solid chloride is compared. The results show a remarkable improvement in storage stability by using the mixed surfactant systems of the present invention having a negative β parameter.

TABLE 11

| | 6a | 6b | 6c |
|---|---|---|---|
| Ammonium nitrate | 57.77 | 57.77 | 57.77 |
| Calcium nitrate | 14.00 | 14.00 | 14.00 |
| Water | 16.34 | 16.24 | 16.24 |
| Thiourea | 0.40 | 0.40 | 0.40 |
| Acetic acid | 0.03 | 0.03 | 0.03 |
| Sodium acetate | 0.06 | 0.06 | 0.06 |
| Sorbitan mono oleate | 0.50 | — | — |
| Emulsifier of Example II | 2.00 | — | — |
| Mixed emulsifiers of Example 2 | — | 3.00 | — |
| Mixed emulsifiers of Example 3 | — | — | 3.00 |
| Paraffin oil | 4.00 | 3.50 | 3.50 |
| Sodium chloride | 5.00 | 5.00 | 5.00 |

TABLE 12

| | 6a | 6b | 6c |
|---|---|---|---|
| Average droplet size (micron) | 2.1 | 1.90 | 1.85 |
| Storage stability at room temp (weeks) | 3 | >25 | >25 |
| Storage stability at 50° C. (weeks) | <1 | >2 | >2 |

We claim:

1. An emulsion explosive having a discontinuous oxidizer salt phase, a continuous oil phase, and an emulsifier for stabilization of the emulsion, wherein said emulsifier comprises a surfactant mixture of a branched chain hydrocarbon surfactant and a branched chain hydrocarbon co-surfactant, wherein said surfactant mixture has an interaction parameter ($\beta$) with a value of zero or less, said surfactant mixture being one wherein both the surfactant and co-surfactant comprise a poly[alk(en)yl] succinic anhydride based compound, the interfacial tension of said emulsion explosive being less than the interfacial tension of a similar emulsion explosive wherein one of said surfactant and said co-surfactant is lacking.

2. The emulsion explosive claimed in claim 1 wherein $\beta$ has a value of $-2$ or less.

3. The emulsion explosive claimed in claim 1 wherein said poly[alk(en)yl] succinic anhydride based compound is derived from isobutylene.

4. The emulsion explosive claimed in claim 1 wherein the surfactant has a molecular weight of less than 1000.

5. The emulsion explosive claimed in claim 1 wherein the co-surfactant has a molecular weight of less than 500.

6. The emulsion explosive claimed in claim 1 wherein the surfactant and the co-surfactant contain similar repeat units on the branched hydrocarbon chain.

7. The emulsion explosive claimed in claim 6 wherein each of the surfactant and the co-surfactant comprise different head groups.

8. The emulsion explosive claimed in claim 1 wherein the surfactant and the co-surfactant contain the same head group, and different hydrocarbon chain repeat units.

9. The emulsion explosive claimed in claim 1 wherein the surfactant mixture consists of a surfactant having a long tail group based on a poly[alk(en)yl] succinic anhydride and a head group based on diethanolamine, and a co-surfactant having a shorter tail group based on a poly[alk(en)yl] succinic anhydride and a head group based on monoethanolamine.

10. The emulsion explosive claimed in claim 9 wherein the surfactant having a long tail group accounts for >70% of said surfactant mixture.

11. The emulsion explosive claimed in claim 1 wherein the said surfactant and co-surfactant are each a derivative of a polyisobutylene succinic anhydride with at least one alkanolamine providing the head group, said surfactant being selected from the group consisting of (a) polyisobutylene succinic anhydride having an average molecular weight of 1000 (HPSEC)/diethanolamine;

(b) polyisobutylene succinic anhydride having an average molecular weight of 1000 (HPSEC)/ethanolamine; and (c) polyisobutylene succinic anhydride having an average molecular weight of 1000 (HPSEC)/diethanolamine and triethanolamine; and said co-surfactant is selected from the group consisting of (i) polyisobutylene succinic anhydride having an average molecular weight of 450 (HPSEC)/diethanolamine;

(ii) polyisobutylene succinic anhydride having an average molecular weight of 450 (HPSEC)/ethanolamine;

(iii) polyisobutylene succinic anhydride having an average molecular weight of 700 (HPSEC)/diethanolamine; and (iv) polyisobutylene succinic anhydride having an average molecular weight of 700 (HPSEC)/ethanolamine.

* * * * *